US007125473B2

(12) United States Patent
Anderson

(10) Patent No.: US 7,125,473 B2
(45) Date of Patent: Oct. 24, 2006

(54) APPARATUS AND METHOD FOR CONDITIONING A WEB ON A PAPERMAKING MACHINE

(75) Inventor: Dennis W. Anderson, Middletown, NY (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 10/661,759

(22) Filed: Sep. 12, 2003

(65) Prior Publication Data

US 2005/0056392 A1 Mar. 17, 2005

(51) Int. Cl.
*D21F 7/06* (2006.01)

(52) U.S. Cl. ..... 162/263; 162/272; 162/199; 162/202; 162/204; 34/448; 34/465; 34/452; 34/460

(58) Field of Classification Search ..... 162/263, 162/272, 199, 202, 204; 34/448, 465, 452, 34/460, 463

See application file for complete search history.

(56) References Cited

U.S. PATENT DOCUMENTS

| | | | |
|---|---|---|---|
| 393,770 | A | 12/1888 | Lorimer |
| 992,688 | A | 5/1911 | Pope |
| 2,176,093 | A | 10/1939 | Merrill |
| 2,772,606 | A | 12/1956 | Kelly |
| 3,071,869 | A | 1/1963 | Latimer et al. |
| 3,284,285 | A | 11/1966 | Holden |
| 3,303,576 | A | 2/1967 | Sisson |
| 3,304,626 | A | 2/1967 | Leckner |
| 3,362,076 | A | 1/1968 | Bailey |
| 3,362,080 | A | 1/1968 | Daane |
| 3,418,723 | A | 12/1968 | Burgess et al. |
| 3,447,247 | A | 6/1969 | Daane |
| 3,503,136 | A | 3/1970 | Fleissner |
| 3,702,503 | A | 11/1972 | Nichols |
| 3,714,720 | A | 2/1973 | Drost |
| 3,771,236 | A | 11/1973 | Cando |
| 3,838,000 | A | 9/1974 | Urbas |
| 4,207,143 | A | 6/1980 | Glomb |

(Continued)

*Primary Examiner*—Mark Halpern
(74) *Attorney, Agent, or Firm*—Matthew M. Eslami

(57) ABSTRACT

An apparatus and method for conditioning a moving porous web on a papermaking machine is disclosed. The web has a first and a second surface and a high temperature gaseous boundary layer adjacent at least the second surface. The apparatus contains means for conveying the first surface of the porous web adjacent a support surface in a direction of travel, means for applying a cooling gas against the second surface of the web in a direction substantially normal to the second surface of the web to exert a gas pressure adjacent the second surface, means for stripping at least a portion of the boundary layer away from the second surface of the web prior to contacting the web with the cooling gas, and means for exerting a vacuum force adjacent the first surface of the web associated with the support means and substantially opposite the location at which the pressure force is exerted adjacent the second surface of the web in order to promote, by a combination of the pressure and vacuum forces, a flow of gas through the web from the second surface to the first surface. The apparatus may also include means for moisturizing the web subsequent to cooling the web. The apparatus and method provide a novel combination of stripping and gas pressure/vacuum force effects for more rapid and efficient removal of the boundary layer at the speeds of modern papermaking machines to improve the condition of the web for further on-line treatments, such as calendaring.

10 Claims, 3 Drawing Sheets

U.S. PATENT DOCUMENTS

| | | | |
|---|---|---|---|
| 4,207,998 | A | 6/1980 | Schmid |
| 4,231,164 | A | 11/1980 | Barbee |
| 4,253,247 | A | 3/1981 | Bergstrom |
| 4,274,210 | A | 6/1981 | Stengard |
| 4,321,760 | A | 3/1982 | Meier |
| 4,462,169 | A | 7/1984 | Daane |
| 4,476,636 | A | 10/1984 | Gross |
| 4,689,895 | A | 9/1987 | Taylor |
| 4,698,914 | A | 10/1987 | Shu |
| 4,738,197 | A | 4/1988 | Malkia |
| 4,763,424 | A | 8/1988 | Taylor |
| 4,785,985 | A | 11/1988 | Hurtgen |
| 4,836,894 | A | 6/1989 | Chance |
| 4,889,146 | A | 12/1989 | Beal |
| 4,905,379 | A | 3/1990 | Wedel |
| 5,038,495 | A | 8/1991 | Jacobs |
| 5,062,216 | A | 11/1991 | Hannigan |
| 5,149,401 | A | 9/1992 | Langevin |
| 5,274,930 | A | 1/1994 | Ensign |
| 5,299,364 | A | 4/1994 | Heikkila |
| 5,331,749 | A | 7/1994 | Thiele |
| 5,383,288 | A | 1/1995 | Ilmarinen |
| 5,440,821 | A | 8/1995 | Hamrin |
| 5,470,436 | A | 11/1995 | Wagle |
| 5,471,847 | A | 12/1995 | Murray |
| 5,522,151 | A | 6/1996 | Deshpande et al. |
| 5,524,532 | A | 6/1996 | Koivukunnas |
| 5,535,527 | A | 7/1996 | Virta |
| 5,553,394 | A | 9/1996 | Cosley |
| 5,569,359 | A | 10/1996 | Joiner |
| 5,575,084 | A | 11/1996 | Vuorinen |
| 5,581,906 | A | 12/1996 | Ensign |
| 5,598,643 | A | 2/1997 | Chuang |
| 5,630,285 | A | 5/1997 | Kerttula |
| 5,661,911 | A | 9/1997 | Ye-Kauppila |
| 5,778,559 | A | 7/1998 | Winheim |
| 5,884,415 | A | 3/1999 | Sims |
| 6,032,385 | A | 3/2000 | Bischel et al. |
| 6,142,391 | A | 11/2000 | Seyed-Yagoobi |
| 6,145,759 | A | 11/2000 | Susa |
| 6,189,237 | B1 | 2/2001 | Mayer et al. |
| 6,207,020 | B1 | 3/2001 | Anderson |
| 6,613,195 | B1 | 9/2003 | Anderson |

APPARATUS AND METHOD FOR CONDITIONING A WEB ON A PAPERMAKING MACHINE

FIELD OF THE INVENTION

The invention relates to an apparatus and method for conditioning a fibrous web on a papermaking machine and, more particularly, to an apparatus and method for conditioning a moving fibrous web coming out of the dryer unit carrying a high temperature boundary layer wherein a substantial part of the boundary layer is rapidly and effectively removed by a novel combination of stripping and gas pressure/vacuum force effects to improve the condition of the web for further treatments.

BACKGROUND

In processes for manufacturing paper and paperboard (referred to hereinafter as "paper"), it is often desirable to condition a moving paper web between stages of the process, especially between the later stages of drying and subsequent calendering. The conventional process of drying paper involves urging water out of the web by a combination of mechanical and thermal means, i.e., use of vacuum and squeeze rolls along with a dryer unit in which the paper web is carried in serpentine fashion through a series of co-rotating steam-filled cylinders where opposite surfaces of the web are placed in contact with the hot surfaces of the cylinders in rapid alternating succession until the web is dried. As the paper is being dried, boundary layers of hot air tend to develop adjacent the opposite surfaces of the web and within pores of the web, all of which have been found to significantly hinder efforts to cool the web as it proceeds to subsequent calendering or other treatments where a cooled web is desirable.

The difficulties in cooling a paper web proceeding from a dryer unit are becoming more pronounced with the ever-increasing speeds of modern papermaking machines. Accordingly, a significant amount of cooling gas is now often required to not only penetrate the boundary layers of hot gases adjacent the web surface, but also to penetrate into the web pores to displace hot gases therein and thereby effectively and efficiently cool the web.

It is therefore an object of the present invention to provide an apparatus and associated method for conditioning a fibrous web.

Another object of the invention is to provide an apparatus and method for cooling a moving fibrous web.

Still another object of the invention is to provide an apparatus and method for efficiently removing at least a portion of an air boundary layer carried adjacent a fibrous web.

Yet another object of the invention is to provide an apparatus and method for cooling and moisturizing a moving fibrous web.

A further object of the invention is to provide an apparatus and method for efficiently cooling a fibrous web.

An additional object of the invention is to provide an apparatus and method of the character described which is relatively simple and is readily adaptable for use with conventional papermaking machines and processes.

SUMMARY OF THE INVENTION

With regard to the foregoing and other objects, the present invention provides an apparatus and method for conditioning a fibrous web having opposed first and second surfaces and a high temperature gaseous boundary layer adjacent at least the second surface. In accordance with one of its aspects, the invention relates to a web conditioning apparatus which comprises means for conveying the web in a direction of travel, means for applying a flow of cooling gas against the second surface of the web, preferably in a direction substantially normal to the second surface of the web and the direction of travel, in order to cause a gas pressure to be exerted against the second surface, and means for stripping away at least a portion of the boundary layer from adjacent the second surface of the web prior to applying the cooling gas against the second surface of the web. The apparatus also includes means for exerting a vacuum force adjacent the first surface of the web at a location substantially opposite the location at which the cooling gas is applied to the second surface of the web.

The invention also relates to a method for conditioning a fibrous web having first and second surfaces and a high temperature gaseous boundary layer adjacent at least the second surface which comprises conveying the web in a direction of travel, applying a cooling gas against the second surface of the web, preferably in a direction substantially normal to the second surface of the web and to the direction of travel, in order to cause a gas pressure to be exerted against the second surface, stripping at least a portion of the boundary layer away from the second surface of the web prior to applying the cooling gas against the web, and exerting a vacuum force adjacent the first surface of the web at a location substantially opposite the location at which the cooling gas is applied against the second surface of the web.

In still another embodiment, the invention provides an apparatus for conditioning a moving porous paper web on a papermaking machine wherein the web has first and second surfaces and a high temperature gaseous boundary layer adjacent at least the second surface and high temperature gas and/or vapor in pores of the web adjacent the first and second surfaces of the web. The apparatus includes at least one roll capable of conveying the web in a direction of travel adjacent a moving support having a support surface with the first surface of the web supported adjacent the support surface and the second surface of the web facing away from the support surface. At least one orifice such as a nozzle in flow communication with a cooling gas supply applies a flow of cooling gas against the second surface of the web, preferably in a direction substantially normal to the second surface of the web, in order to cause a gas pressure force to be exerted against the second surface. At least one air deflector such as an airfoil strips away at least a portion of the boundary layer from adjacent the second surface of the web prior to applying the flow of cooling gas thereagainst. The apparatus also includes a vacuum chamber associated with the support surface for exerting a vacuum force against the first surface of the web supported adjacent the support surface wherein the vacuum force is sufficient to withdraw high temperature gas and/or vapor from at least pores adjacent the first surface of the web into the vacuum chamber and wherein the vacuum force is exerted adjacent a location on said first surface substantially opposed to the location at which the pressure force is maintained adjacent said second surface in order to promote a flow of cooling gas into the web from adjacent the second surface in the direction of the first surface.

For many applications of the invention the paper web will exhibit sufficient permeability through the web thickness to enable passage of gas therethrough, wherein application of cooling gas against the second surface in combination with exerting of a vacuum force adjacent the first surface at a location substantially opposite the location at which the cooling gas is applied provides a "push-pull" effect in which the cooling gas creates a relatively high pressure zone adjacent the second surface of the web and the vacuum force exerts a relatively low pressure zone adjacent the first surface, thereby inducing a flow of gas through the web. It is further noted that the stripping away of the hot gaseous boundary layer from adjacent the second surface facilitates development of the desired high pressure zone adjacent the second surface and the consequent movement of cooling gas through the web. All this is accomplished in a very rapid and efficient manner to accommodate the high speed operation of modern papermaking machines achieving the desired cooling of the paper as it is advanced to subsequent calendering or other treatment stages.

A further advantage of the invention is that the web may be cooled and/or conditioned with less energy and at higher speeds than with conventional apparatus. Furthermore, the apparatus requires less space and can therefore be retrofitted into existing papermaking machines with minimal effort or reconfiguration.

DESCRIPTION OF THE DRAWINGS

The above and other features and advantages of the invention will now be further described in the following detailed description of various embodiments of the invention considered in conjunction with the drawings in which.

DETAILED DESCRIPTION OF THE PREFERRED EMBODIMENTS

Figure 1:
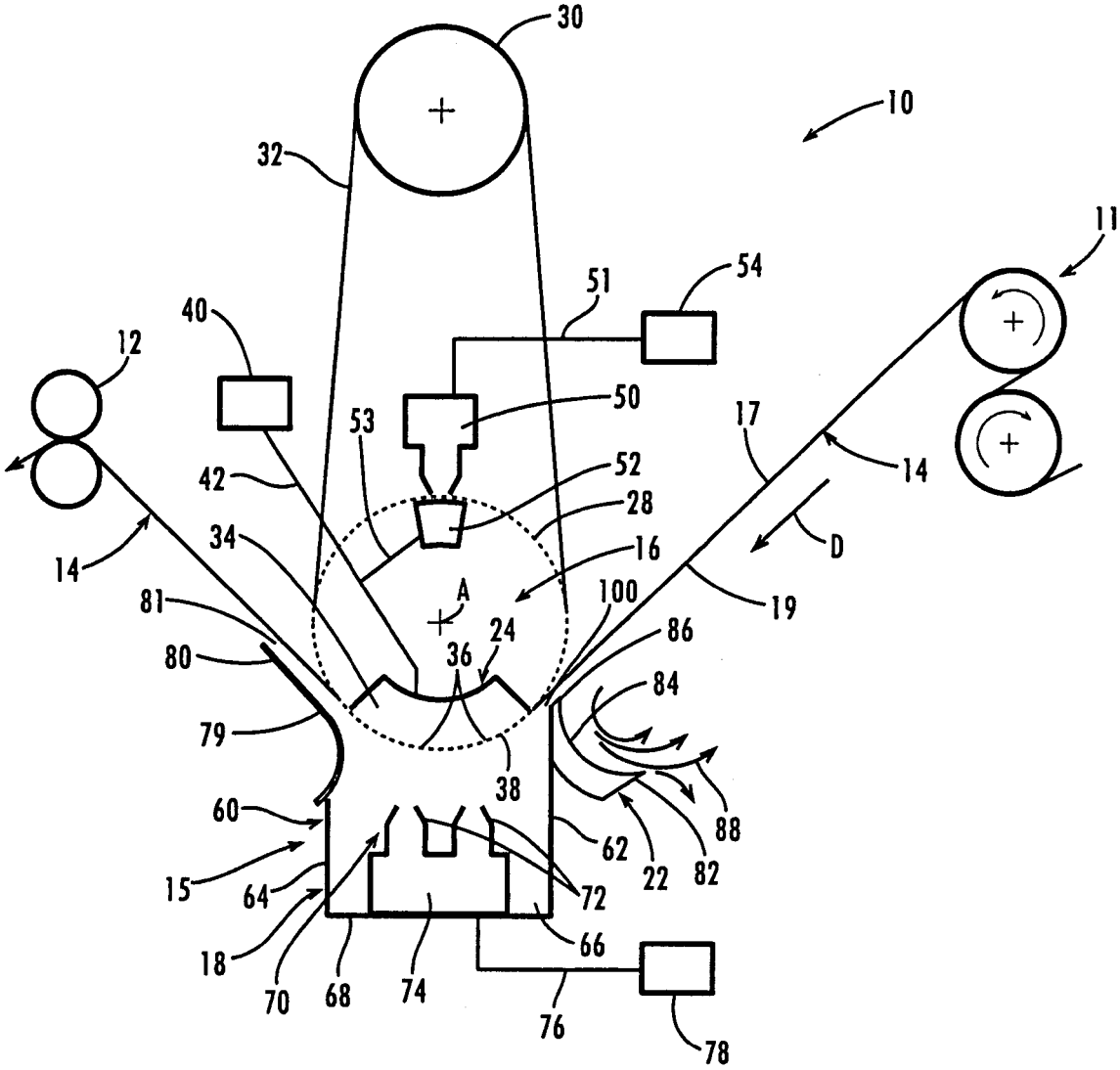
FIG. 1 is a side elevational view illustrating features of a web conditioning apparatus according to one embodiment of the invention.

Referring now to the drawings in which like reference characters designate like or similar parts throughout the several views, an apparatus 10 according to one embodiment of the invention shown in FIG. 1 comprises means for conveying a fibrous paper web 14 in a direction D through a conditioning unit 15 which includes support means 16 supporting a first surface 17 of the web, means 18 for applying a cooling gas pressure force against a second surface 19 of the web, means 22 for stripping away at least a portion of a high temperature boundary layer carried adjacent the second surface 19 of the web 14 prior to applying the cooling gas pressure force against the second surface 19, and vacuum means 24 associated with the support means 16 for exerting a vacuum force adjacent the first surface 17 of the web.

In the illustrated embodiment, means for conveying the web 14 includes a conventional papermaking dryer unit indicated diagrammatically by reference numeral 11 and calender unit illustrated diagrammatically by reference number 12, with both units 11 and 12 having a plurality of rollers suitable for conveying the web 14 and with the conditioning unit 15 being located in an open draw between units 11 and 12. It will be appreciated that in the conventional papermaking machine certain measures are taken in order to cause the operative elements of dryer unit 11 and calender unit 12 to be driven so that web 14 is advanced in progression from one unit to the next whereby the span of web in the open draw between units 11 and 12 is maintained under an appropriate tension force. Those of ordinary skill having knowledge of such measures and the means by which their objectives are fulfilled, the details thereof will be omitted herein for purposes of brevity. Interposition of conditioning unit 15 between units 11 and 12 is only illustrative of one embodiment, and is not believed to significantly affect the normal tensioning and advancement of web 14 from unit 11 to unit 12.

Support means 16 in the embodiment of FIG. 1 preferably includes a perforated drum or cylinder 28 supported on its ends for rotation about axis A, which together with roller 30 (and appropriate means for keeping porous fabric 32 in alignment with web 14) carries an endless felt or other highly porous fabric 32 under sufficient tension to keep the fabric 32 securely upon both cylinder 28 and roller 30 in driving contact therewith. Cylinder 28 and/or roller 30 are preferably rotatably driven by suitable means known to those of ordinary skill in order to cause fabric 32 to be advanced therearound at a speed substantially matching that of web 14 so as not to impose any undue drag or pull force upon web 14 as it progresses from unit 11 to unit 12.

Figure 1A:
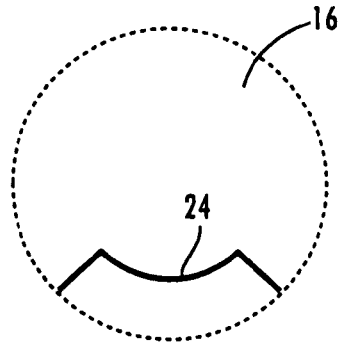
FIG. 1A is a side elevational view illustrating features of a web conditioning apparatus according to another embodiment of the invention.

Vacuum means 24 associated with support means and cylinder 16, 28 is preferably provided by an elongate vacuum chamber 34 supported within cylinder 28 adjacent the inner surface of the cylinder. Preferably the chamber 34 has an open face in close proximity to the perforated cylinder walls and a sealing mechanism such as wiper seals to form a seal and to limit the loss of vacuum. This arrangement is depicted in FIG. 1A. Alternatively, the chamber 34 may have a plurality of through perforations 36 that open to its outer circumferential surface 38 and extend along the axial length of the wall a sufficient width to present an area of perforations across the width of the paper web 14. Perforations 36 are sized and spaced so as to enable withdrawal of gas therethrough into the interior of chamber 34 at a rate sufficient to exert the necessary vacuum force against the first surface 17 of web 14. Vacuum chamber 34 is connected in flow communication with a vacuum source 40 via conduit 42. As the cylinder 28 rotates about the vacuum chamber 34, a sealing mechanism, such as wiper seals, is employed along the leading and trailing edges of the vacuum chamber 34 to provide a vacuum seal between the inner surface of the cylinder 28 and the vacuum chamber 34. A suitable cylinder and vacuum chamber is described in further detail in U.S. Pat. No. 2,772,606 to Kelly, the contents of are incorporated herein by reference. It is also appreciated that while the chamber 34 is depicted as having an arcuate shape in general conformance with the shape of the cylinder 28, the chamber 34 may employ various, non-arcuate shapes as well. Moreover, the vacuum means could also be provided by other structures such as by one or more vacuum orifices which are provided in suitably close proximity to the web and in flow communication with a suitable source of reduced pressure such as a vacuum pump or a steam jet ejector vacuum system.

By virtue of the vacuum force exerted against the first surface 17 of the web 14, gas and vapors flow from adjacent and within the web 14 through the porous fabric 32 (against which web 14 is in direct physical contact), through perforations 36 in the perforated cylinder 28, and into chamber 34. The fabric 32 and perforated cylinder 28 are sufficiently permeable to enable a flow of gas and vapors therethrough, but without significantly affecting the desired texture of web 14 on the first surface 17 or otherwise resulting in any marks left on the web surface 17 as a result of the vacuum force exerted thereon.

The apparatus 10 also preferably includes means for cooling the cylinder 28. Such means may comprise an elongate nozzle 50 positioned so as to spray or otherwise apply a cooling fluid along the length of cylinder 28 as the cylinder rotates. The cooling fluid may be a gas, such as air, or, in one embodiment, chilled moisturized air supplied via conduit 51 from source 54.

In another embodiment, the cooling means for cylinder 28 additionally comprises a second vacuum chamber 52 evacuated via conduit 53 by the same or a different vacuum source as at 40 used to draw from chamber 34 via conduit 42, such as by connecting conduit 53 to conduit 42. Chamber 52 is preferably of an elongate, cylindrical segment-shaped configuration and is dimensioned, perforated, and positioned with respect to the inner wall of cylinder 28 in substantially the same manner as chamber 34, with the exception that it may have a substantially shorter circumferential length viewed cross-sectionally. As a cooling fluid is applied to cylinder 28, the fluid is drawn through the perforated surface thereof into chamber 52 and/or caused to evaporate by the vacuum source in fluid flow communication with second chamber 52.

Means 18 for applying a cooling gas preferably comprises an elongate chamber 60 (at least as long as the width of web 14) with side walls 62 and 64, end walls 66 (only back wall 66 is shown for simplicity), and a bottom wall 68 upon which a nozzle array 70 is supported, having a plurality of nozzles 72 configured to direct jets of fluid against the second surface 19 of web 14 across its width. Preferably, interior chamber or plenum 74 of array 70 communicates cooling fluid from a source of cooling fluid shown at 78 (delivered via conduit 76) under sufficient pressure to nozzles 72.

The cooling fluid from nozzles 72 is preferably chilled air having temperature in the range of from about 40° F. to about 160° F., most preferably from about 60° F. to about 100° F. The preferred range of relative humidity will vary depending on both the temperature of the chilled air and the precise nature of web conditioning being performing such as cooling and/or moistening. It is believed that those of ordinary skill in the art will be able to determine appropriate humidity levels for the desired conditioning of the web. Preferably, cooling air supplied to nozzle 50 via conduit 51 has the same temperature and humidity, and sources 78 and 54 may therefore be the same.

Nozzles 72 are preferably sized and arranged so as to direct cooling fluid substantially normal to and against the second surface 19 of the web 14 across the width of the web to exert a pressure force against the web at a location substantially opposite the location at which the vacuum force is exerted by vacuum means 24. The result is, in the case of a web 14 having a degree of permeability, a "push-pull" effect on the web to promote passage of gases and vapors therethrough and therefrom and a resultant rapid and effective cooling of the web. Even with a web 14 that exhibits little permeability, the combination of pressure forces applied to one side and vacuum forces applied to the other side in accordance with the invention promotes a rapid and efficient cooling and conditioning of the web.

A preferred nozzle for use with the cooling fluid is a narrow "slot" type nozzle known as an "air knife." In a preferred embodiment, the air knife has a single narrow slot with a width of from about 0.001 inch to about 0.125 inch which directs a flow of cooling fluid directly against the second surface 19 of the web at a velocity of about 100 feet per minute or greater, more preferably, at least about 500 feet per minute. A single air knife may be employed or a plurality of air knives may be employed as needed to span the entire cross-directional width of the web 14. Air knives are known for use in other applications and a suitable air knife is available from ExAir Corporation of Cincinnati, Ohio.

Those of ordinary skill in the art will also appreciate that the while a plenum 74 and two nozzles 72 have been depicted herein, the exact number of nozzles 72 employed may be greater or less depending on the size of the nozzles 72 and cooling demands of the particular application. It is within the scope of the invention to dispense with the plenum 74 and or the elongate chamber 60 in certain applications wherein the web 14 is relatively easily cooled or conditioned such as with a highly porous web. However it is generally preferred to employ a plurality of nozzles 72 connected to a plenum 74 within an elongate chamber 60 as this arrangement has been found to provide maximum cooling efficiency.

In still another alternative cooling means, the nozzles 72 may be omitted and the cooling gas applied through a simple ductwork which ends with a plenum in close proximity to the web 14 which directs a flow of cooling gas generally towards the web 14 at an elevated pressure, typically about 1-2 psi above ambient conditions. If needed a sealing mechanism, such as wiper seals or deflector blades, may be employed with the plenum so as to limit the loss of cooling gas and maintain an elevated cooling gas pressure adjacent the web 14.

Prior to cooling the web 14, at least a portion of a boundary layer of warm or hot gases and vapors moving with the web is preferably stripped away from the second surface 19 of the web 14 via stripping means 22. It is believed that a web carried through air will tend to develop a layer of air that clings to the surface of the web as a boundary layer. This boundary layer tends to grow in thickness as it is carried along with the moving web. When, as in the present case, the web is proceeding out of dryer unit 11, the gases of the boundary layer will also tend to be hot. The hot boundary layer of gas associated with the second web surface 19 is believed to act as a sort of insulator and limit ability of the cooling gas emitted from the cooling gas nozzles 72 to make the desired contact with the second surface 19 and effectively cool the web. Therefore, stripping means 22 are preferably provided to strip away at least a portion of the hot boundary layer carried adjacent the second surface 19 of the web in order to improve the interaction of the cooling gas with the web.

In one embodiment, stripping means 22 comprises at least one air deflector. A particularly preferred deflector is an air foil 82 which displaces a portion of the boundary layer from the second surface 19 of the web 14 as the web is conveyed past the air foil 82 toward cylinder 28 in direction D. The air foil 82 is positioned in close proximity to the second surface 19 of the web 14, and preferably has a concave-shaped face 84 terminating closely adjacent surface 19 in an elongate edge 86 that extends across the width of the web. Edge 86 in combination with the shape of surface 84 effectively "peels" away a substantial part of boundary layer gas causing it to flow as indicated by arrow 88 away from web's second surface 19.

The air foil 82 is most preferably mounted adjacent cylinder 28 in a retractable manner so that the air foil may be moved away from the cylinder for maintenance purposes.

Also the distance of the air foil 28 away from the web 14 may be varied in accordance with the thickness of the boundary layer.

In certain embodiments, the invention also preferably includes an additional, downstream air foil for promoting the development of a boundary layer of relatively cool gas adjacent the web. A downstream foil 79 attached to sidewall 64 exposes a convex surface to the second web surface 19 that gradually converges to a generally parallel, spaced-apart relation with the web surface 19 terminating in end edge 80 that extends across at least the width of the web. A space 89 is therefore provided between web surface 19 and foil 79 through which excess gas emitted from nozzle 72 may escape chamber 60. Space 89 is preferably sufficiently long in the direction of movement of the web 14 to cause gas flowing out of space 89 to develop a boundary layer of relatively cool gas adjacent surface 19, and to also limit any tendency of web 14 to flutter as a result of the escaping gas velocity.

Other stripping means may also be employed. As shown in the embodiment of the apparatus 10' of FIG. 2, in addition to or in place of air foil 82, another embodiment of stripping means 22' may comprise an entry jet box 90 for applying a jet of pressurized gas from a plenum 91 onto web 14 substantially tangential to the second surface 19 of the web 14 and substantially opposite the direction of web travel direction D. In this embodiment of the invention, pressurized gas flows from plenum 91 out of an elongate gas jet slot 92 at a high velocity, preferably at a rate of from about 1000 to about 10,000 ft/min., and slot 92 is preferably spaced within about ½ inch of web surface 19.

By directing pressurized gas in this manner and in close proximity to the second web surface 19 at sufficient velocity, the boundary layer associated with the second web surface 19 is further disrupted and/or stripped therefrom prior to the web 14 coming under the influence of cooling gas from nozzles 72 of chamber 60. Cooled gas enters plenum 91 via conduit 95 from a suitable source shown at 96. While a variety of gases may be employed in the jet box 90, it is preferred to use cooled air for economic reasons. It is particularly preferred to use cooled air which is supplied from the same source under the same temperature/humidity conditions as air supplied to plenum 74 and chamber 50, in which case source 96 could be the same as sources 54 and 78. However, the temperature of gas supplied to box 90 is not as critical, although it should be no warmer, and preferably somewhat cooler than that of the boundary layer gases which are to be stripped. The stripping gas therefore may not need to be cooled or be of a low temperature since it functions primarily to disrupt the hot gas boundary layer moving with web 14 before the web is cooled using nozzles 72. A preferred temperature for the stripping gas used in unit 90 ranges from about 70° F. to about 160° F.

Figure 2:
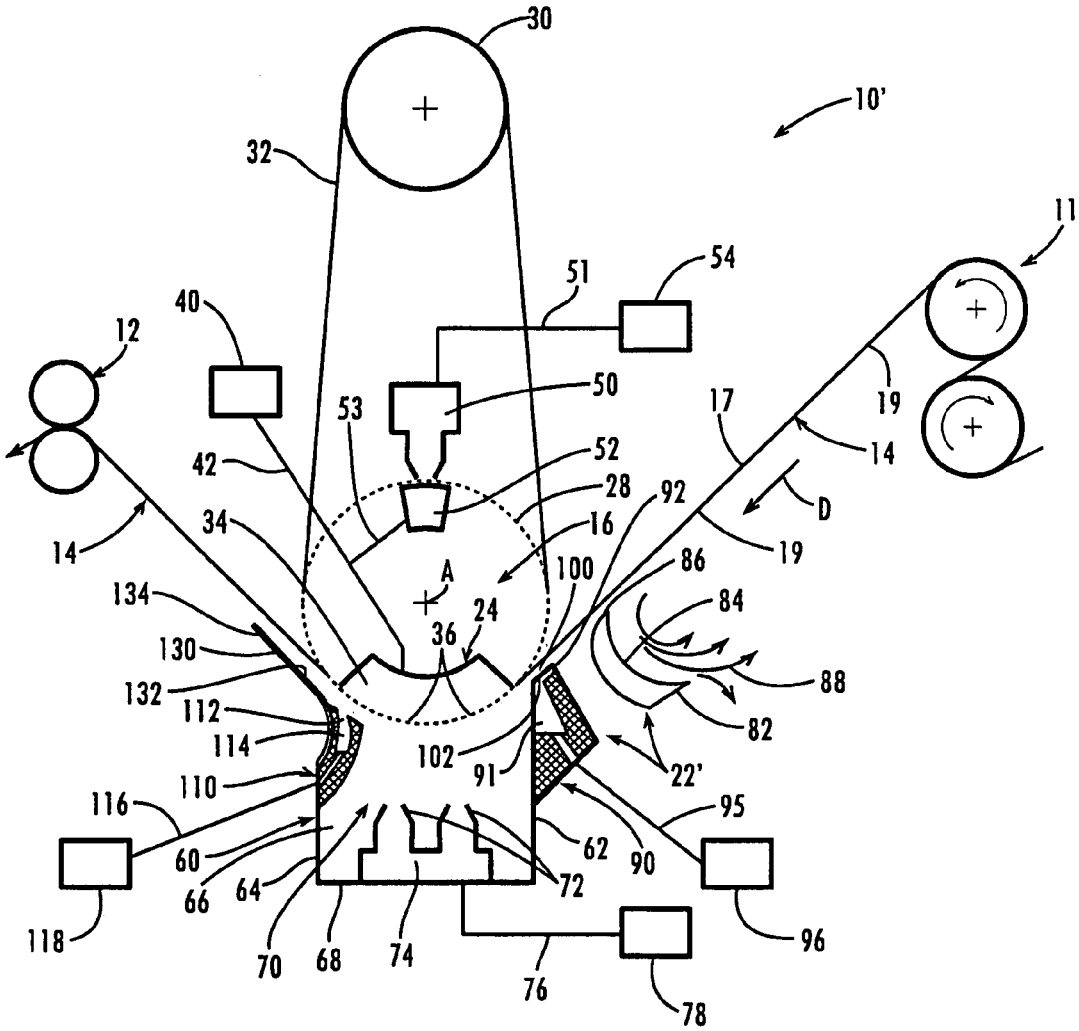
FIG. 2 is a side elevational view illustrating features of a web conditioning apparatus according to still another embodiment of the invention.

Entry jet box 90 is preferably located downstream of foil member 82 as shown in FIG. 2, just upstream of or adjacent to an elongate slot 100 that extends across the outer edge of an outwardly projecting elongate lip 102 extending along the upper edge of wall 62 of chamber 60 across at least the width of the web 14. In fact, it is preferred to use the outside surface of lip 102 to form the back surface or wall of nozzle 92 of box 90. Slot 100 in turn is defined, on its side closest to cylinder 28, by web surface 19, and its side away from cylinder 28, by the structure of lip 102. Air from the interior of pressurized chamber 60 is emitted from slot 100 and, together with gas emitted from box 90 (if used), provides an even further enhanced scrubbing away of hot boundary layer gases carried along adjacent surface 19 of web 14.

It will be appreciated that, although believed to be less preferred, box 90 may also be positioned upstream of foil 82. In this embodiment, box 90 may offer the advantage of disrupting the boundary layer so that it is more effectively peeled away by foil edge 86, and slot 100 will still supply scrubbing air against surface 19 of web 14 before it encounters cooling unit 18.

As the web 14 emerges from chamber 60, in certain embodiments it is preferred to further cool the same by applying high velocity cooling gas in close proximity and parallel to the second surface 19 from exit jet box 110 having an elongate slot 112 which is preferably configured, dimensioned, and arranged substantially the same as slot 92 on box 90, with the exception that cooled gas exiting slot 112 is directed generally tangential to the surface 19 of web 14 and in substantially the same direction as the direction of movement of the web. Cooled gas is delivered to slot 112 from plenum 114, which in turn is in flow communication via conduit 116 with a suitable source of cooled gas 118, which may be the same or different than sources 96, 54, and 78. However, if a different cooling gas source is employed, it is preferred that the temperature of gas 118 is at least as cool as the temperature of gas 78.

In association with exit jet box 110, it is preferred to use an elongate foil 130 extending at least across the width of web 14 and preferably spaced from web surface 19 in the range of from about 0.1 inch to about 1.0 inch, most preferably about 0.25 to about 0.5 inch. In a preferred embodiment, an interior surface 132 of foil 130 initiates as a smooth transition from the opening of slot 112 and extending out from slot 112 a substantial distance along the direction of travel of web 14.

Interior surface 132 of foil 130 preferably has a generally convex-shaped surface facing the second web surface 19, and includes an outer end area 134 that converges with and becomes substantially parallel to the web surface 19 along its path of travel toward the end of the foil 130. The foil 130 therefore directs a flow of cooling gases in close proximity to the web surface 19 (as with foil 79 of FIG. 1) so that a boundary layer of cool gas is set up adjacent surface 19 and is carried along with web 14 as the web 14 is conveyed along its direction of travel toward calender unit 12 or further treatment.

Figure 3:
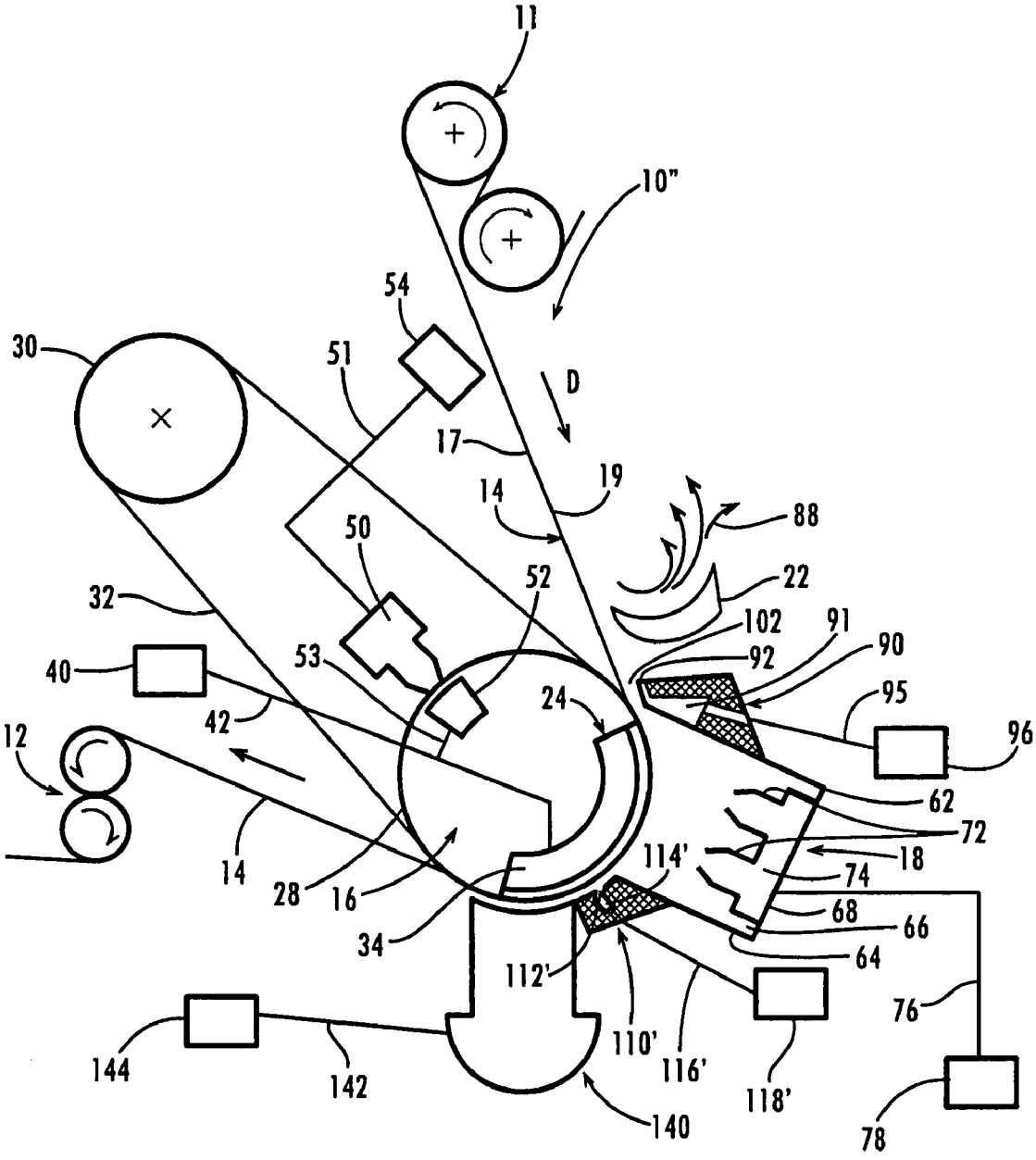
FIG. 3 is a side elevational view illustrating features of a web conditioning apparatus according to yet another embodiment of the invention.

With reference to FIG. 3, a further embodiment of the apparatus 10" having substantially the same features as that of FIG. 2 has added thereto a downstream moisturizing unit 140 for increasing the moisture content of the web 14 as it leaves the apparatus. Unit 140 is preferably a steam box positioned adjacent the take-off point of the web 14 from cylinder 28 in close proximity to web surface 19. The steam box is connected via conduit 142 to a suitable source of steam 144, which is applied to web surface with a steam quality and in a manner sufficient to moisturize the web 14 as desired for further operations. Alternatively, other moisturizing devices may by used such as a moisturizing shower, spray nozzles, or other devices known to those skilled in the art. Use of steam box 140 in connection with the apparatus of the invention is believed to be particularly advantageous as a single vacuum box 34 may be used to withdraw both the steam emitted by steam box 140 and the cooling gas. This represents an improvement in efficiency and compactness as heretofore the use of a steam box in a papermaking process has necessitated the installation of a separate vacuum system to withdraw and exhaust the steam.

In the illustrated embodiment wherein the web 14 is moisturized with steam, it is preferred to remove any boundary layer of cool gases which may develop adjacent web surface 19 as a result of cooling gas supplied by cooling unit 18. To this end, exit jet box 110' is modified relative to the unit 110 shown in FIG. 2 in order to cause elongate slot 112' to direct gas generally tangentially to web surface 19 supported on cylinder 28 just downstream of the location of surface 19 onto which cooling gas from nozzles 72 impinge the web, and in a direction generally opposite to the direction of travel of the web 14. Gas flow from slot 112' strips boundary layer gases away from web surface 19 so that the web may be more effectively moisturized by unit 140.

Those of ordinary skill are well-versed in how to equip, assemble, and operate steam boxes and other such moisturizing devices, and the details of the same are therefore omitted for the sake of brevity and simplicity. However, it is important to note that the moisturizing according to the invention may be especially desirable, for example, when the next operation is a calendering treatment or other such treatment where a moisture content of web 14 near its surface 19 above that ordinarily expected to be present following treatment using apparatus embodiments 10, 10' and others is desired.

It is also to be noted that with any of the exemplary embodiments described herein and others within the scope of this invention, the equipment may include two or more apparatus 10, 10', and/or 10" in series where the treatments carried out upon the first and second surfaces 17 and 19 of the web 14 are carried out, say, on second surface 19 just as shown in any of FIGS. 1–3, and then arranged to cause the treatments to be carried out on first surface 17. In this way, both surfaces 17 and 19 of web 14 may be treated and the treatment may be caused to penetrate through or have a desirable effect within the inner parts of webs that exhibit relatively low permeability. However, it is to be noted that in many instances a single pass of web 14 through apparatus configured according to the invention will be sufficient for downstream operations.

It is contemplated that the apparatus and method of the present invention will be used for conditioning moving webs which may travel at a rate ranging from about 500 to about 5000 feet per minute. In the most typical situation, a web of paper will be formed and at least partially dried by methods known to those skilled in the papermaking art. The web, which is still quite hot after drying, will be processed through the apparatus of the present invention which will cool it and, optionally, re-moisturize the web as described with reference to FIG. 3, adding an amount of moisture which may range from about 0.5 to about 10 grams/$m^2$.

The various embodiments of the present invention disclosed herein provide many advantages over the prior art. As previously described, much of the prior art has been directed to web processing methods and equipment which address other unit processes such as drying but provide little guidance as to methods and apparatus for efficiently cooling and conditioning rapidly moving webs. The present invention offers advantages over the prior art by specifically addressing how to efficiently cool a web surface and to force warm air out from within the pores and voids of the web to enhance the cooling of the web. The invention also includes provision for developing a boundary layer of cool gas adjacent the cooled web, as well as optional moisturizing after a web has already been cooled.

Additionally, at least in certain embodiments of the invention, the properties of the web itself are improved relative to the prior art. For example, it has been found that webs treated according to the present invention may exhibit improved smoothness after calendering, particularly at lower web densities. High smoothness values are typically only achieved when the paper web has been calendered to a high density level; however, the invention provides webs which have comparable smoothness values at lower density levels.

Also, webs conditioned according to the invention exhibit are believed to exhibit improved surface densities for improved coating holdout, i.e., the webs have an improved and more uniform resistance to penetration of coatings such as latexes or sizing solutions applied to the surface of the web. More of the coating solution is believed to be held out on or near the surface of the web.

Finally, it is believed that webs conditioned according to the invention exhibit reduced yellowing and color reversion as compared to the prior art. Without being bound by theory, it is surmised that the reactions which cause yellowing or color reversion in bleached papers predominantly occur at relatively elevated temperatures and that the improved color performance is due to the more rapid cooling of the web according to the invention. The rapid cooling reduces the amount of time the web is at an elevated temperature where yellowing reactions may occur.

Having now described various aspects of the invention and known preferred embodiments thereof, it will be recognized by those of ordinary skill that numerous modifications, variations, and substitutions may exist within the scope and spirit of the appended claims.

What is claimed is:

1. An apparatus for conditioning a moving porous paper web on a papermaking machine in a direction of travel wherein the web has first and second surfaces and a high temperature gaseous boundary layer adjacent at least the second surface and high temperature gas and/or vapor in pores of the web in flow communication with the first and/or second surfaces of the web, the apparatus comprising:

a moving support having a support surface with the first surface of the web supported adjacent the support surface and the second surface of the web facing away from the support surface;

at least one air deflector for stripping away at least a portion of the boundary layer from adjacent the second surface of the web prior to applying the flow of cooling gas there against;

at least one orifice in flow communication with a cooling gas supply for applying a flow of cooling gas against the second surface of the web in order to cause a gas pressure to be exerted against the second surface;

an entry jet box configured to direct a high velocity cooling gas over the porous paper web in a direction opposite to a direction in which the porous paper web moves;

a vacuum chamber associated with the support surface for exerting a vacuum force against the first surface of the web supported adjacent the support surface wherein the vacuum force is sufficient to withdraw high temperature gas and/or vapor from at least pores adjacent the first surface of the web into the vacuum chamber and wherein the vacuum force is exerted adjacent a location on said first surface substantially opposed to the location at which the pressure force is maintained adjacent said second surface in order to promote a flow of gas through the web from adjacent the second to adjacent the first surface and into the vacuum chamber; and a moistening device configured to moisten the web adjacent to the moving support wherein the moistening device comprises a plurality of steam nozzles adjacent to the second surface of the web which results in steam condensation on the second surface of the web and within an interior region of the web.

2. The apparatus of claim 1 wherein the moving support comprise a rotating cylinder having a cylindrical perforated surface defining the support surface thereof providing flow communication between the exterior of the cylinder and the interior of the cylinder by flow of gas through the perforations, with the perforated cylindrical surface supporting the first surface of the web adjacent at least a portion of the perforated surface, said vacuum chamber being disposed within said rotating cylinder closely adjacent the portion of the perforated surface adjacent which the first surface of the web is supported so that high temperature gas and/or vapor withdrawn from the web by the vacuum force pass through perforations in the perforated surface and into the vacuum chamber.

3. The apparatus of claim 2 wherein the moving support further includes an endless porous support fabric carried on the support surface between the support surface and the first surface of the web so that gas and/or vapor withdrawn from the web passes through the support fabric and then into the perforations in the cylinder.

4. The apparatus of claim 1 further comprising at least one nozzle in flow communication with a cooling gas for cooling the support surface.

5. The apparatus of claim 1 further comprising at least one nozzle for applying a pressurized gas directed substantially tangential to the second surface of the web and substantially opposite to the web travel direction and upstream of the moving support.

6. The apparatus of claim 1 further comprising at least one nozzle for applying a flow of a second cooling gas directed substantially tangential to the second surface of the web and along the web travel direction adjacent to and downstream of the moving support so that at least a portion of the second cooling gas develops a boundary layer of cool gas carried adjacent the second surface of the web.

7. The apparatus of claim 6 wherein the plurality of steam nozzles supported in close proximity to the second surface of the web and connected in flow communication with a source of steam for delivering steam against the second surface of the web causes the steam to condense on the second surface of the web and within an interior region of the web.

8. The apparatus of claim 1 further comprising a moistening gas source for applying moist gas to the web adjacent to and downstream of the moving support to increase the moisture content of the web.

9. The apparatus of claim 1 wherein the flow of cooling gas and the vacuum chamber in conjunction with the web surface and porosity are sufficient to cause a flow of gas through the web from adjacent the second to adjacent the first surface.

10. The apparatus of claim 1 further comprising a source of vacuum configured against the first web surface and opposite of the steam nozzle such that the web travels between the source of vacuum and the steam nozzle.

* * * * *